US012084821B2

(12) United States Patent
Liu et al.

(10) Patent No.: US 12,084,821 B2
(45) Date of Patent: Sep. 10, 2024

(54) FOLDABLE WINDPROOF UNIT, LARGE-SPAN WINDPROOF NET STRUCTURE THEREOF AND WINDPROOF METHOD

(71) Applicant: SHIJIAZHUANG TIEDAO UNIVERSITY, Hebei (CN)

(72) Inventors: Qingkuan Liu, Hebei (CN); Xiaobing Chai, Hebei (CN); Yifei Sun, Hebei (CN); Zhen Li, Hebei (CN); Xi Wang, Hebei (CN); Nian Liu, Hebei (CN); Yangxue Wang, Hebei (CN); Xing Chang, Hebei (CN); Saifei Fu, Hebei (CN)

(73) Assignee: Shijiazhuang Tiedao University, Hebei (CN)

( * ) Notice: Subject to any disclaimer, the term of this patent is extended or adjusted under 35 U.S.C. 154(b) by 171 days.

(21) Appl. No.: 18/071,494

(22) Filed: Nov. 29, 2022

(65) Prior Publication Data

US 2024/0102256 A1 Mar. 28, 2024

(30) Foreign Application Priority Data

Sep. 26, 2022 (CN) ..... 202211169036.3

(51) Int. Cl.
*E01F 7/02* (2006.01)

(52) U.S. Cl.
CPC ..... *E01F 7/025* (2013.01)

(58) Field of Classification Search
CPC ..... E01F 7/00; E01F 7/02; E01F 7/025; E01F 7/04; E01F 7/045; E04H 17/133; E04H 17/135; E04H 17/139
(Continued)

(56) References Cited

U.S. PATENT DOCUMENTS 146,046 A * 12/1873 Congdon ..... E04H 17/133 256/42
323,316 A * 7/1885 Glidden ..... E04H 17/139 256/43

(Continued)

FOREIGN PATENT DOCUMENTS

CN 107401321 A 11/2017
CN 209882680 U 1/2020
DE 202013103523 U1 * 12/2014 ..... E01F 7/045

*Primary Examiner* — Josh Skroupa
(74) *Attorney, Agent, or Firm* — Brooks Kushman, P.C.

(57) ABSTRACT

A foldable windproof unit, a large-span windproof net structure thereof, and a windproof method. The foldable windproof unit comprises a flexible windproof net, towers arranged at intervals, and a load-bearing rope erected on the two towers. The tower on one side is provided with a horizontal pulley assembly, and the tower on the other side is provided with two vertical pulleys. The top edge of the flexible windproof net is slidably connected to the load-bearing rope by means of a plurality of hanging structures. The foldable windproof unit further comprises a traction rope, the traction rope is arranged on the horizontal pulley assembly in a sleeving manner, and the two free ends of the traction rope extend to respectively bypass the two vertical pulleys and are connected to winding mechanism. The hanging structure close to the tower on one side is fixedly connected to the traction rope.

20 Claims, 4 Drawing Sheets

(58) Field of Classification Search
USPC ..... 256/12.5, 40, 41, 42, 43, 44
See application file for complete search history.

(56) References Cited

U.S. PATENT DOCUMENTS

| | | | | | |
|---|---|---|---|---|---|
| 536,400 | A * | 3/1895 | Sensenig | E04H 17/133 | 256/41 |
| 578,086 | A * | 3/1897 | McDaniel | E04H 17/135 | 256/42 |
| 2,827,265 | A * | 3/1958 | McKillop | E06B 11/021 | 49/34 |
| 5,720,573 | A * | 2/1998 | Benedict | E02B 3/04 | 256/12.5 |
| 5,871,038 | A * | 2/1999 | Gompertz | E01F 13/028 | 49/34 |
| 7,429,225 | B1 * | 9/2008 | Shull | A63B 69/38 | 473/474 |
| 10,738,424 | B2 * | 8/2020 | Journeaux | E01F 7/045 | |
| 2007/0176158 | A1 * | 8/2007 | Robinson | E01F 13/028 | 256/12.5 |

* cited by examiner

FOLDABLE WINDPROOF UNIT, LARGE-SPAN WINDPROOF NET STRUCTURE THEREOF AND WINDPROOF METHOD

CROSS-REFERENCE TO RELATED APPLICATION

This application claims foreign priority benefits under 35 U.S.C. § 119(a)-(d) to Chinese Patent Application No. 202211169036.3, filed on Sep. 26, 2022, which is hereby incorporated herein by reference in its entirety.

TECHNICAL FIELD

The present disclosure relates to the technical field of windproof nets, and in particular relates to a foldable windproof unit, a large-span windproof net structure thereof, and a windproof method.

BACKGROUND

Flying dust is one of the causes of environmental pollution, while windproof net is a major means to effectively suppress dust flying. The wind speed after passing through the windproof net is reduced, thus the material pile is protected, and the purposes of wind prevention and dust suppression are further achieved. Wind-prevention and dust-suppression nets are arranged at both sides of the road to play a role of suppressing sand and dust, thus effectively reducing the adverse effects of sand and wind on the normal operation of the road. In addition, the windproof nets are arranged at both sides of high-speed railway and highway to play a role of wind prevention and noise reduction. However, existing windproof nets for material pile yards and traffic lines are both in a fixed structure form, generally employing a combination of fixed steel supports and rigid windproof nets or a combination of fixed steel supports and flexible windproof nets, and regardless of form, once built, the windproof nets are permanent facilities. Moreover, as the existing fixed windproof nets are based on the supporting steel supports, there are shortcomings of incapability of being folded, large steel consumption and high cost.

For outdoor snow sports competition fields, the snow groomer is required to pass back and forth to shape the snowy surface, and thus the windproof net needs to be unfolded in a competition and folded after the competition, if the fixed windproof net structure which cannot be folded is adopted, the passing of the snow groomer may be seriously affected, resulting in the increase of maintenance cost for outdoor snow sports competition events.

In accordance with the Chinese patent with Authorization Publication number CN209882680U, a windproof net for crop cultivation is provided. During use, the windproof net is unfolded in a direction perpendicular to a direction of wind blowing, a supporting rod at one end of the windproof net is fixed into the land, and meanwhile, a connecting rod is inserted into a limiting through slot, and the connecting rod is fixed into the land, thus the windproof net can be used for wind prevention. When not in use, the connecting rod is taken out from the limiting through slot, and a rotating rod is started by a control switch to contract the windproof net. According to the solution, although the windproof net can be folded and unfolded, the windproof net is only suitable for being used in crop cultivation environment conditions, the connecting rods need to be manually inserted, and the windproof net is apparently not suitable for being used in large fields.

In accordance with the Chinese patent with Application Publication number CN107401321A, an adjustable windproof net for an orchard is disclosed. A first fixed stand column is fixedly connected to a cross beam, a second fixed stand column is fixedly connected to the cross beam, a movable stand column is hung on a fixed rope, and a protective net is installed between the movable stand column and the second fixed stand column. A traction rope is arranged on the movable stand column, and the two ends of the traction rope are wound around a fixed pulley and then wound around a reel for several circles to facilitate the reel to drive the traction rope to move better, the reel is arranged on a rotating shaft, an air releaser can drive the rotating shaft to rotate forwards and reversely, the rotation of the rotating shaft can drive the traction rope to pull the movable stand column to move left and right, thus achieving the unfolding and folding of the windproof net. It can be seen from the solution that the movable stand column is required to drive the windproof net to act to achieve unfolding and closing. However, for the large-span windproof net, if the movement of the movable stand column is used to drive the windproof net to be unfolded and folded, how to guarantee the stability of the movable stand column needs to be considered at first. Apparently, the solution is only suitable for being used in orchards rather than large-scale fields.

Therefore, how to provide a large-span windproof net structure suitable for outdoor snow sports competition events is a technical problem urgent to be solved.

SUMMARY

An objective of the present disclosure is to provide a foldable windproof unit, a large-span windproof net structure thereof and a windproof method to solve the problems in the prior art. A flexible windproof net is supported by means of a load-bearing rope, and the flexible windproof net is driven, by a traction rope, to slide on the load-bearing rope under the action of a winding mechanism, such that the large-span flexible windproof net structure can be unfolded. Therefore, the large-span flexible windproof net structure, when applied to outdoor snow sports competition events, can be unfolded during a competition and can be folded after the competition, and is suitable for outdoor snow sports competition fields.

To achieve the objective above, the present disclosure provides the following solutions:

The present disclosure provides a foldable windproof unit. The foldable windproof unit comprises a flexible windproof net, towers arranged at intervals, and a load-bearing rope erected on the two towers. The tower on one side is provided with a horizontal pulley assembly, and the tower on the other side is provided with two vertical pulleys. The top edge of the flexible windproof net is slidably connected to the load-bearing rope by means of a plurality of hanging structures. The foldable windproof unit further comprises a traction rope, the traction rope is arranged on the horizontal pulley assembly in a sleeving manner, and the two free ends of the traction rope extend to respectively bypass the two vertical pulleys and are connected to a winding mechanism. The hanging structure close to the tower on one side is fixedly connected to the traction rope, and the flexible windproof net is driven to be unfolded or folded through the forward and reverse rotation of the winding mechanism.

Preferably, the hanging structure employs a suspension pulley.

Preferably, the horizontal pulley assembly comprises a single horizontal pulley, a spacing distance between the two vertical pulleys is equal to the diameter of the horizontal pulley, the height of the horizontal pulley is identical to that of the vertical pulley; or the horizontally pulley assembly comprises two horizontal pulleys, the spacing distance between the two vertical pulleys is equal to a spacing distance between the two horizontal pulleys, and the height of the horizontal pulley is identical to that of the vertical pulley.

Preferably, the cross section of the tower is of a U-shaped structure, the tower of the U-shaped structure forms an accommodating cavity for accommodating the folded flexible windproof net.

Preferably, two side edges of the flexible windproof net are connected to the corresponding towers by vertical edge connectors, respectively, and the bottom edge of the flexible windproof net is connected to ground anchors by bottom edge connectors.

Preferably, the vertical edge connectors and the bottom edge connectors each comprises a safety hook.

Preferably, the foldable windproof unit comprises a plurality of limiting ropes, the two ends of each of the limiting ropes are connected to the two towers, respectively; and the plurality of limiting ropes are distributed on the two surfaces of the flexible windproof net.

Preferably, the winding mechanism employs a double-drum winch mechanism; and the double-drum winch mechanism is located at the bottom of the tower.

The present disclosure provides a large-span windproof net structure. The large-span windproof net structure comprises a plurality of foldable windproof units recited as above, wherein the adjacent foldable windproof units can share one tower, one side of the tower is provided with the vertical pulley, and the other side of the tower is provided with the horizontal pulley assembly.

The present disclosure further provides a windproof method, which uses the foldable windproof unit recited as above, and comprises the following:

During wind prevention, a winding mechanism rotates forwards to drive hanging structures, by a traction rope, to move in a direction from a tower on the other side to a tower on one side along a load-bearing rope, the flexible windproof net is driven by the hanging structures to be gradually unfolded, and the unfolded flexible windproof net plays a role of wind prevention.

After the wind prevention is finished, the winding mechanism rotate reversely to drive the hanging structures, by the traction rope, to move in a direction from the tower on one side to the tower on the other side along the load-bearing rope, and the flexible windproof net is driven by the hanging structures to be gradually folded.

Compared with the prior art, the present disclosure obtains the following technical effects:

(1). A flexible windproof net is supported by means of a load-bearing rope, and the flexible windproof net is driven, by a traction rope, to slide on the load-bearing rope under the action of a winding mechanism, such that the large-span flexible windproof net structure can be unfolded. Therefore, the large-span flexible windproof net can be unfolded during a competition and can be folded after the competition when applied to outdoor snow sports competition events, and is suitable for outdoor snow sports competition fields.

(2). When the horizontal pulley assembly employs a single horizontal pulley, a spacing distance between the two vertical pulleys is equal to the diameter of the horizontal pulley, and the height of the horizontal pulley is identical to that of the vertical pulley. After a traction rope is arranged on the horizontal pulley in a sleeving manner and bypasses the vertical pulleys, the trend of the traction rope can be adapted to the shape change of the horizontal pulley and the vertical pulleys and can be better attached into the pulley grooves of the horizontal pulley and the vertical pulleys, thus preventing the rope from being separated from the pulley grooves and guaranteeing the reliability and stability of the action of the flexible windproof net. When the horizontal pulley assembly employs two horizontal pulleys, the spacing distance between the two vertical pulleys is equal to a spacing distance between the two horizontal pulleys, and the height of the horizontal pulley is identical to that of the vertical pulley. The two horizontal pulleys can be well adapted to the change of the spacing distance between the two free ends of the traction rope in a case that the diameter of each of the horizontal pulley is not increased obviously, and thus the traction rope is stably guided.

(3). The cross section of the tower is of a U-shaped structure, the tower of the U-shaped structure forms an accommodating cavity for accommodating the folded flexible windproof net, thus preventing the flexible windproof from being damaged after the flexible windproof net is folded. Meanwhile, the tower of the U-shaped structure can also effectively improve the stability of the tower so as to form effective supporting for the flexible windproof net.

(4). Limiting ropes are distributed on the two surfaces of the flexible windproof net, which may restrain the deformation of the flexible windproof under the wind action, improve the connection stability of the flexible windproof net and the tower, and avoid the damage under wind action.

BRIEF DESCRIPTION OF THE DRAWINGS

To describe the technical solutions in the embodiments of the present disclosure or in the prior art more clearly, the following briefly introduces the accompanying drawings required for describing the embodiments. Apparently, the accompanying drawings in the following description show merely some embodiments of the present disclosure, and those of ordinary skill in the art may still derive other drawings from these accompanying drawings without creative efforts.

Figure 1:
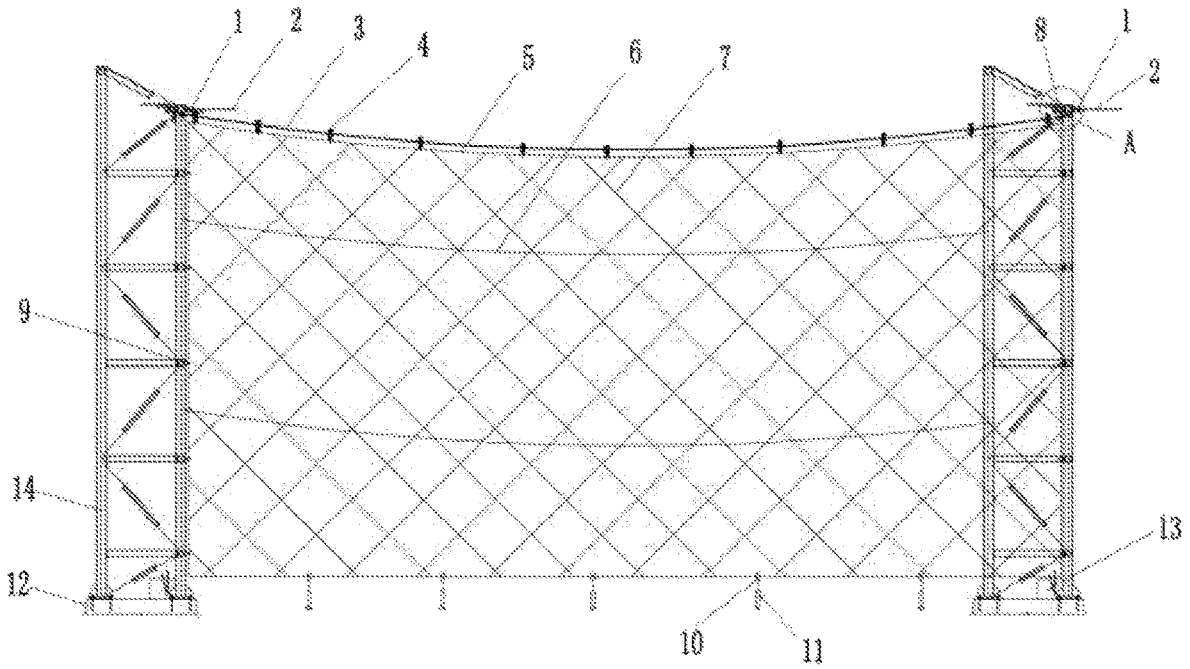
FIG. 1 is a structure diagram of a foldable windproof unit in accordance with the present disclosure.
Figure 2:
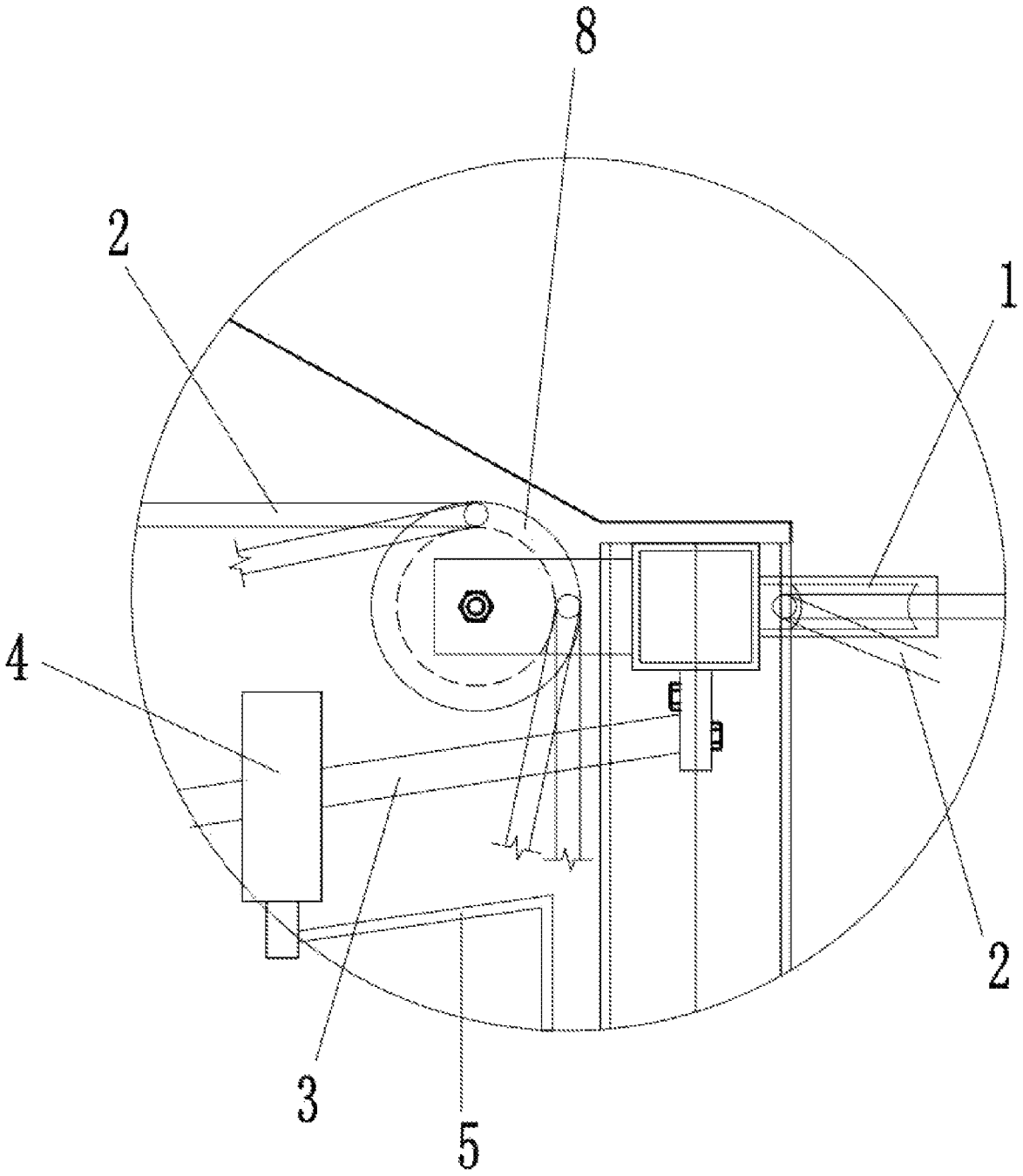
FIG. 2 is an enlarged view of A in FIG. 1.

In the drawings: 1—horizontal pulley; 2—traction rope; 3—load-bearing rope; 31—hanging point; 4—hanging structure; 5—edge-covering rope; 6—limiting rope; 7—flexible windproof net; 8—vertical pulley; 81—support; 9—vertical edge connector; 10—bottom edge connector; 11—ground anchor; 12—reinforced concrete foundation; 13—winding mechanism; 14—tower.

DETAILED DESCRIPTION

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by those of ordinary skill in the art based on the embodiments of the present disclosure without creative efforts shall fall within the scope of protection of the present disclosure.

An objective of the present disclosure is to provide a foldable windproof unit, a large-span windproof net structure thereof and a windproof method to solve the problems in the prior art. A flexible windproof net is supported by means of a load-bearing rope, and the flexible windproof net is driven, by a traction rope, to slide on the load-bearing rope under the action of a winding mechanism, such that the large-span flexible windproof net structure can be unfolded. Therefore, the large-span flexible windproof net structure, when applied to outdoor snow sports competition events, can be unfolded during a competition and can be folded after the competition, and is suitable for outdoor snow sports competition fields.

To make the above objective, the features and advantages of the present disclosure more apparently, the present disclosure is further described in detail below with reference to the accompanying drawings and specific embodiments.

Figure 3:
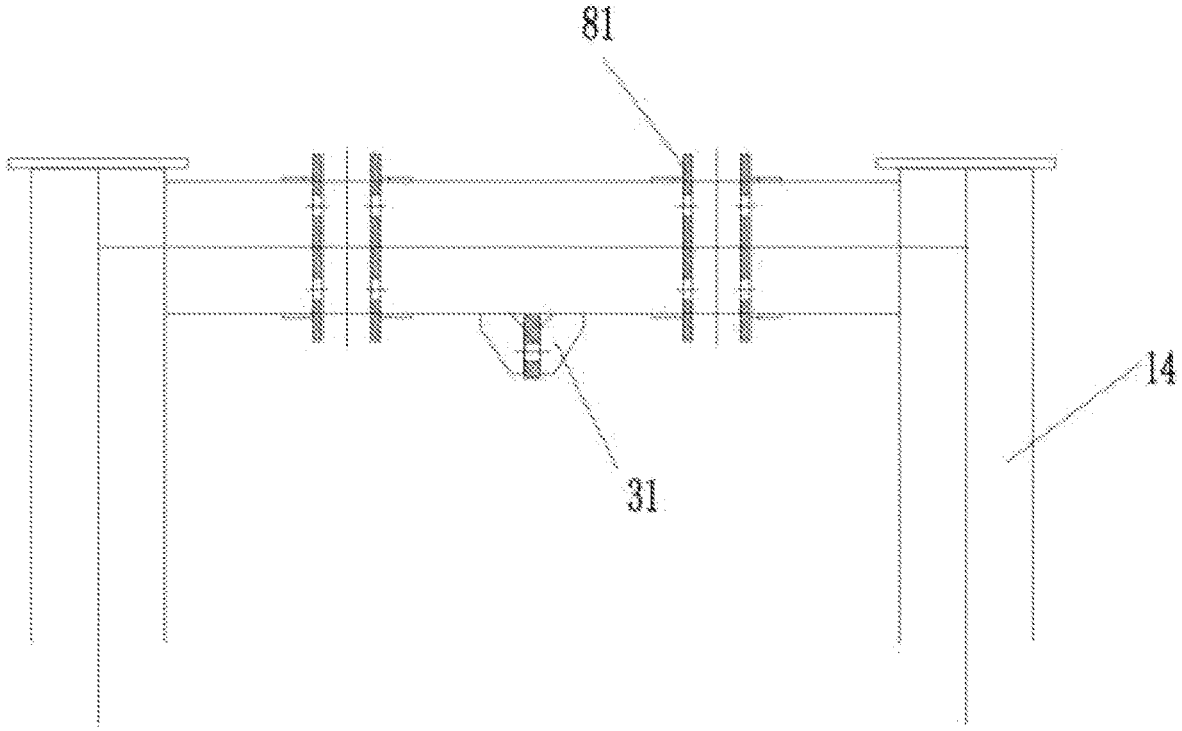
FIG. 3 is a schematic diagram of an installation structure of a vertical pulley in accordance with the present disclosure.
Figure 4:
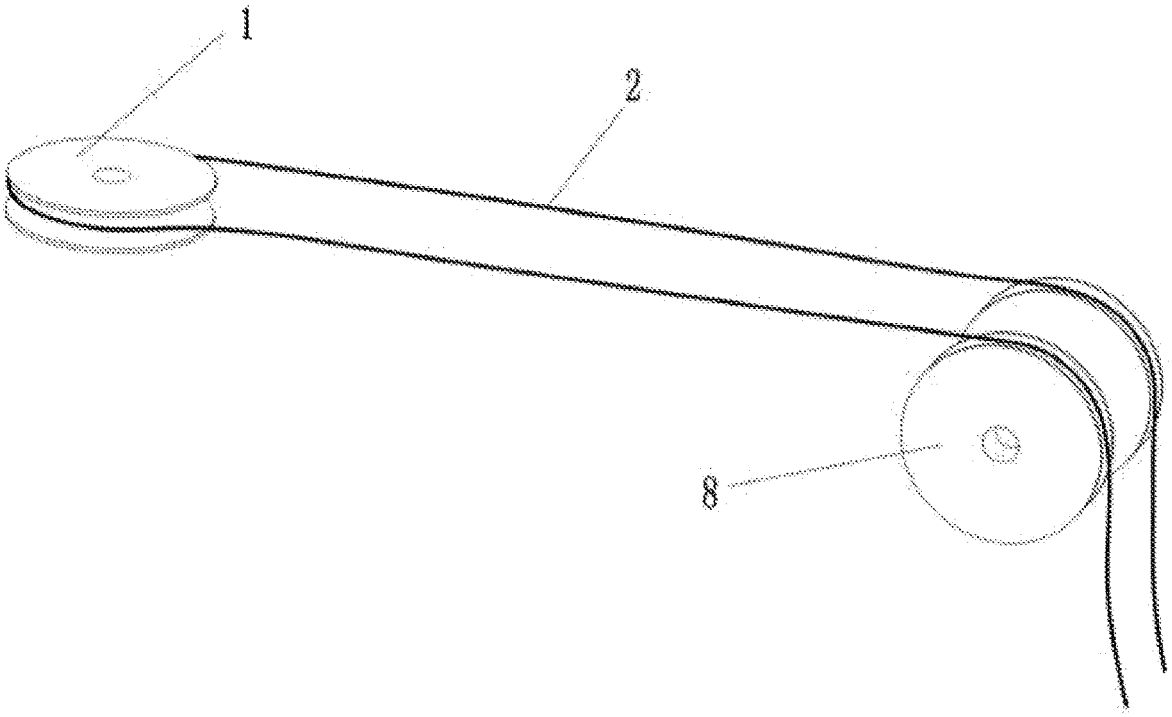
FIG. 4 is a schematic diagram of one form of connection structure of a horizontal pulley assembly, a vertical pulley and a traction rope in accordance with the present disclosure.
Figure 5:
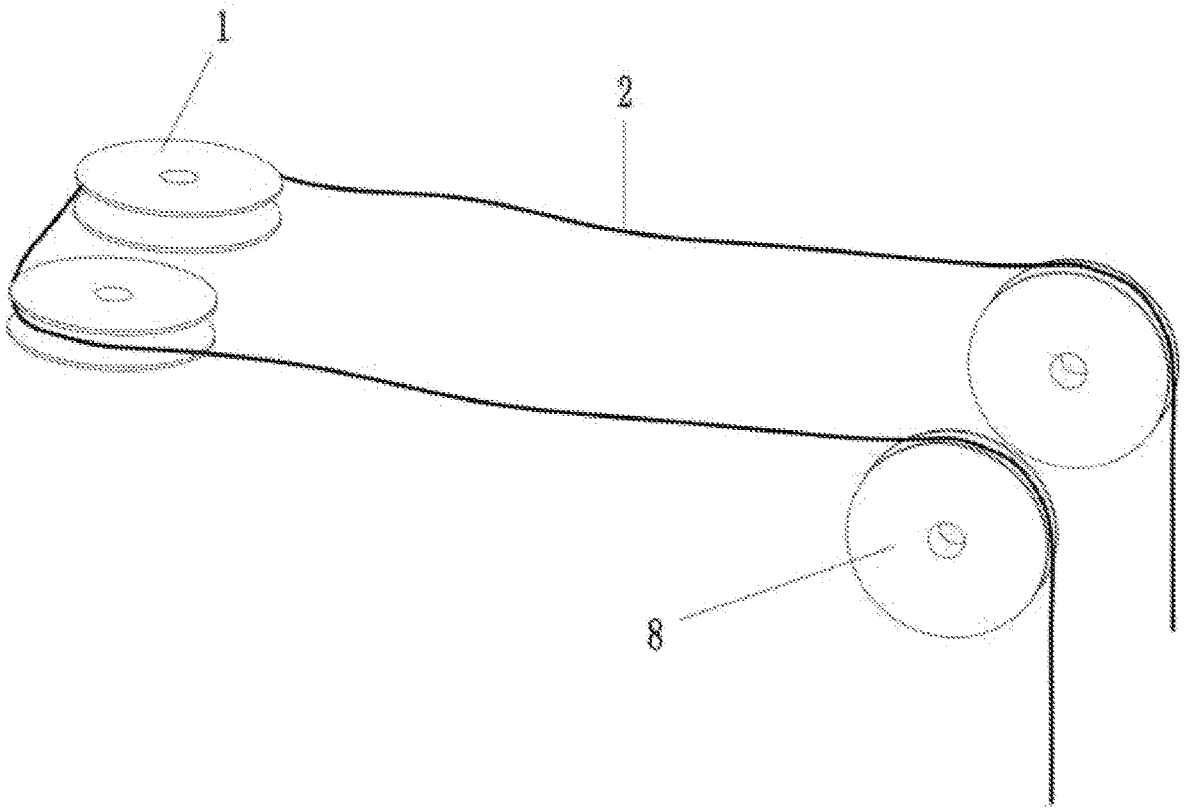
FIG. 5 is a schematic diagram of another form of connection structure of a horizontal pulley assembly, a vertical pulley and a traction rope in accordance with the present disclosure.

As shown in FIG. 1 to FIG. 4, the present disclosure provides a foldable windproof unit. The foldable windproof unit comprises a flexible windproof net 7, towers 14 arranged at intervals, and a load-bearing rope 3 erected on the two towers 14. The flexible windproof net 7 is a net structure made of a flexible material, and meshes of a rectangular structure or a rhombic structure may be formed by staggered connection of flexible ropes, thus facilitating the folding. The tower 14 is installed on a fixed foundation by using a rigid structure. For example, the tower 14 is formed by using a steel frame structure, and the tower 14 is located on a reinforced concrete foundation 12 to serve as a permanent structure, thus forming a supporting column for the flexible windproof net 7. The load-bearing rope 3 may be erected on the two adjacent towers 14 by means of hanging points 31 (as shown in FIG. 3), a suspended load-bearing rope 3 with a certain span is formed by using the towers 14, and the load-bearing rope 3 is configured to suspend the flexible windproof net 7. In the same foldable windproof unit, opposite surfaces of the towers 14 are provided with different structures so as to fold the flexible windproof net 7 from one side to the other side and to open the flexible windproof net 7 from the other side to one side. The tower 14 on one side is provided with a horizontal pulley assembly, and the tower 14 on the other side is provided with two vertical pulleys 8. The horizontal pulley assembly and the vertical pulleys 8 are rotatably arranged on different towers 14. The horizontal pulley assembly comprises one or two horizontal pulleys 1, and a traction rope 2 is guided in a horizontal direction, and then is expanded to a certain width so as to correspond to the vertical pulleys 8 on the other side. It needs to be noted that the horizontal pulley 1 is that a wheel face is in a horizontal direction, and the vertical pulley 8 is that a wheel face is in a vertical direction. In addition, the vertical pulley 8 may be arranged on the tower 14 by a support 81, the position relationship between the two vertical pulleys 8 is defined by means of the support 81 and the arrangement is kept vertical. The support 81 may comprise two portions distributed on the two surfaces of the tower 14, one portion for installing the vertical pulley 8 and the other portion for installing the horizontal pulley 1. The vertical pulley 8 and the horizontal pulley 1 belong to different foldable windproof units. Four edges of the flexible windproof net 7 may be connected by edge-covering ropes 5. The edge-covering rope 5 at the top edge may be slidingly connected to the load-bearing rope 3 by means of a plurality of hanging structures 4, that is, the load-bearing rope 3 serves as a sliding support track for the hanging structures 4 at the moment. The hanging structures 4 and the load-bearing rope 3 may be in smooth surface contact or wheel-shaped structure contact, thus reducing the frictional resistance when the hanging structures 4 slide. The foldable windproof unit further comprises a traction rope 2. The traction rope 2 mainly serves as a power transmission structure for unfolding or folding the flexible windproof net 7. Specifically, the traction rope 2 is arranged on the horizontal pulley assembly in a sleeving manner to form two free ends after bypassing one or two horizontal pulleys 1, and the two free ends of the traction rope 2 extends to respectively bypass the two vertical pulleys 8 and are finally connected to a winding mechanism 13. The winding mechanism 13 provides power to drive the traction rope 2 to reciprocate around the horizontal pulley 1 and the vertical pulleys 8. The winding mechanism 13 may employ a single-drum winch mechanism, a double-drum winch mechanism, and the like. To achieve the purpose of driving the flexible windproof net 7 to act by the traction rope 2, the traction rope 2 is connected to the hanging structure 4 at the edge, that is, the traction rope is connected to the hanging structure 4 close to the tower 14 at one side (i.e., the side provided with the horizontal pulley assembly). At the moment, as the hanging structure 4 is fixedly connected to the traction rope 2, the hanging structure 4 can be driven to move by the traction rope in reciprocation movement. Therefore, the other hanging structures 4 are driven to move accordingly, and then the flexible windproof net 7 is driven to act, that is, the flexible windproof net 7 can be driven to be unfolded or folded through the forward and reverse rotation of the winding mechanism 13. The flexible windproof net 7 is supported by means of the load-bearing rope 3, and the flexible windproof net 7 is driven, by the traction rope 2, to slide on the load-bearing rope 3 under the action of the winding mechanism 13, such that the large-span flexible windproof net 7 structure can be unfolded. Therefore, the large-span flexible windproof net structure, when applied to outdoor snow sports competition events, can be unfolded during a competition and can be folded after the competition, and is suitable for outdoor snow sports competition fields.

The hanging structure 4 may employ a suspension pulley. The suspension pulley comprises a pulley holder and a pulley rotatably arranged on the pulley holder. A pulley groove of the pulley can be embedded into the load-bearing rope 3 and is located above the load-bearing rope 3, and the pulley holder is connected to the edge-covering rope 5 of the flexible windproof net 7. When the suspension pulley is configured for the folding of the flexible windproof net 7, the suspension pulley connected to the traction rope 2 may drive the other suspension pulleys to move towards a folding direction in sequence, and thus the flexible windproof net 7 can be folded.

The horizontal pulley assembly may only comprise one horizontal pulley 1, at the moment, a spacing distance between the two vertical pulleys 8 may be equal to the diameter of the horizontal pulley 1, and the height of the horizontal pulley 1 and the height of the vertical pulley 8 may be kept the same. After the traction rope 2 is arranged on the horizontal pulley 1 in a sleeving manner and bypasses the vertical pulleys 8, the trend of the traction rope 2 can adapt to the shape change of the horizontal pulley 1 and the vertical pulleys 8, and can be better attached to the pulley grooves of the horizontal pulley 1 and the vertical pulleys 8, thus preventing the traction rope 2 from being separated from the pulley grooves, and guaranteeing the action reliability and stability of the flexible windproof net 7. Alternatively, the horizontal pulley assembly may comprise two horizontal pulleys 1, at the moment, the spacing distance between the two vertical pulleys 8 may be equal to a spacing distance between the two horizontal pulleys 1, and the height of the horizontal pulley 1 and the height of the vertical pulley 8 may be kept the same. The two horizontal pulleys 1 can be well adapted to the change of the spacing distance between the two free ends of the traction rope 2 in a case that the diameter of each of the horizontal pulleys 1 is not increased obviously, and the traction rope 2 can be stably guided. In addition, anti-release structures may also be arranged at the corresponding positions of the pulley grooves of the horizontal pulley 1 and the vertical pulley 8, the anti-release structures may be pin rollers or fixed columns parallel to an axial direction of the pulleys and can be configured to restrain the traction rope 2 in a certain space, thus preventing the traction rope 2 from being separated from the pulleys under the conditions of shaking, swinging and the like.

The cross section of the tower 14 may be of a U-shaped structure, the tower 14 of the U-shaped structure forms an accommodating cavity for accommodating the folded flexible windproof net 7. The U-shaped structures of the two adjacent towers 14 have the same unfolding direction. When a plurality of foldable windproof units are combined, each accommodating cavity may be configured to accommodate the flexible windproof net 7. After the flexible windproof net 7 is folded into the accommodating cavity, the flexible windproof net 7 can be protected and prevented from being damaged. Meanwhile, compared with a single column, the tower 14 of the U-shaped structure can also effectively improve the stability of the tower 14, thus forming effective supporting for the flexible windproof net 7.

The two side edges of the flexible windproof net 7 or the edge-covering ropes 5 for the two side edges are connected to the corresponding towers 14 by vertical edge connectors 9, respectively, and the bottom edge of the flexible windproof net 7 or the edge-covering rope 5 for the bottom edge is connected to ground anchors 11 by bottom edge connectors 10. On the tower frame on one side, only after the flexible windproof net 7 is unfolded, the flexible windproof net 7 can be fixed to the tower 14 by the vertical edge connectors 9, and when the flexible windproof net 7 needs to be folded, the vertical edge connectors 9 need to be disconnected. Similarly, only after the flexible windproof net 7 is unfolded, the flexible windproof net 7 can be fixed to the ground anchors 11 by the bottom edge connectors 10, and when the flexible windproof net 7 needs to be folded, the bottom edge connectors 10 need to be disconnected. While on the tower 14 on the other side, the vertical edge connector 9 may be fixedly connected to the tower 14 all the time no matter the flexible windproof net is unfolded or folded.

The vertical edge connector 9 and the bottom edge connector 10 may each comprise a safety hook. The safety hooks are common components for rope connection, and may be threaded to form a loop structure for easy connection and disconnection of the flexible windproof net 7 to, or from, the tower 14 or the ground anchors 11.

The foldable windproof unit may further comprise a plurality of limiting ropes 6. The limiting rope 6 is a full-length rope, the two ends of which are connected to the two adjacent towers 14, respectively. The plurality of limiting ropes 6 are distributed on the two surfaces of the flexible windproof net 7 and preferably arranged in the middle of the flexible windproof net 7. Meanwhile, the edge-covering ropes 5 on the four edges of the flexible windproof net 7 may play the role of the limiting ropes 6 to a certain extent. The limiting rope 6 is not directly connected to the flexible windproof net 7, and only plays a role in limiting and blocking, thus the unfolding and the folding of the flexible windproof net 7 cannot be affected. Therefore, a limiting structure for the flexible windproof net 7 may be formed by means of the limiting ropes 6, which may restrain the deformation of the flexible windproof 7 under the wind action, improve the connection stability of the flexible windproof net 7 and the tower 14, and avoid the damage under wind action.

The winding mechanism 13 may employ a double-drum winch mechanism; and the double-drum winch mechanism is arranged at the bottom of the tower 14. The double-drum winch mechanism may a provide strong traction force for the traction rope 2 and provide enough power for pulling the large-span flexible windproof net 7.

With reference to FIG. 1, the present disclosure provides a large-span windproof net structure, comprising a plurality of foldable windproof units recited as above. The adjacent foldable windproof units can share one tower 14, one side of the tower 14 is provided with a vertical pulley 8, and the other side of the tower is provided with a horizontal pulley assembly. A plurality of towers 14 may all employ the same configuration, i.e., the configuration of the shared tower 14, except for the towers 14 located at the edges. The towers 14 located at the edges may be provided with corresponding components according to the folding and unfolding demands of the corresponding flexible windproof nets 7. For example, as shown in FIG. 1, if the tower 14 on the left side is the outermost tower 14, it is unnecessary to provide the structures such as the winding mechanism 13 and the vertical pulley 8 at the bottom of the tower 14. If the tower 14 at on the right side is the outermost tower 14, it is unnecessary to provide the structures such as the horizontal pulley assembly on the tower 14.

The present disclosure further provides a windproof method, which uses the foldable windproof unit recited as above, and comprises the following:

During wind prevention, a winding mechanism 13 rotates forwards to drive hanging structures 4, by a traction rope 2, to move in a direction from a tower 14 on the other side to a tower on one side along a load-bearing rope 3, the flexible windproof net 7 is driven by the hanging structures 4 to be gradually unfolded, and the unfolded flexible windproof net 7 plays a role of wind prevention.

After the wind prevention is finished, the winding mechanism 13 rotate reversely to drive the hanging structures 4, by the traction rope 2, to move in a direction from the tower 14 on one side to the tower 14 on the other side along the load-bearing rope 3, and the flexible windproof net 7 is driven by the hanging structures 4 to be gradually folded.

Specifically, with reference to FIG. 1, the folding process of the flexible windproof net 7 is as follows:

Step one, after the safety hooks of the bottom edge connectors 10 are released, the ground anchors 11 are separated from the bottom edge connectors 10.

Step two, after the safety hooks of the vertical edge connectors 9 on the left side are released, the tower 14 is separated from the vertical edge connectors 9 on the left side, and at the moment, the safety hooks of the vertical edge connectors 9 on the right side do not need to be released.

Step three, the traction rope 2 is wound on the double-drum winch mechanism, the double-drum winch mechanism rotates to drive the traction rope 2 to rotate around a winding drum, after the double-drum winch mechanism is started, the traction rope 2 drives the hanging structure 4 connected thereto to move towards the tower 14 on the right side, and under the action of traction force, the hanging structures 4 on the load-bearing rope 3 are sequentially collected into an accommodating cavity of the tower 14, and the folding process is completed until the hanging structure 4 connected to the traction rope 2 is collected into the tower 14, and then the rotation of the double-drum winch mechanism can be stopped.

The unfolding process of the flexible windproof net 7 is as follows:

Step one, before the flexible windproof net is unfolded, the hanging structures 4 are all located in the accommodating cavity of the tower 14; after the double-drum winch mechanism is started, the traction rope 2 drives the hanging structures 4 connected thereto to move towards the tower 14 on the left side, under the action of the traction force, the hanging structures 4 on the load-bearing rope 3 are unfolded in sequence, and the rotation of the double-drum winch mechanism can be stopped until a distance between the hanging structure 4 connected to the traction rope 2 and the tower 14 on the left side reaches the connecting distance between the vertical edge connector 9 on the left side and the tower 14.

Step two, the safety hooks of the bottom edge connectors 10 are hooked on the ground anchors 11, and the ground anchors 11 and the flexible windproof net 7 are connected into a whole by the bottom edge connectors 10.

Step three, the safety hooks of the vertical edge connectors 9 on the left side are hooked on the tower 14, and the tower 14 and the flexible windproof net 7 are connected into a whole by the vertical edge connector 9 on the left side.

Several examples are used for illustration of the principles and implementation methods of the present disclosure. The description of the embodiments is merely used to help illustrate the method and its core principles of the present disclosure. In addition, those of ordinary skill in the art can make various modifications in terms of specific embodiments and scope of application in accordance with the teachings of the present disclosure. In conclusion, the content of this specification shall not be construed as a limitation to the present disclosure.

What is claimed is:

1. A foldable windproof unit, comprising:

a flexible windproof net, towers arranged at intervals, and a load-bearing rope erected on the two towers, wherein the tower on one side is provided with a horizontal pulley assembly, and the tower on the other side is provided with two vertical pulleys;

the top edge of the flexible windproof net is slidably connected to the load-bearing rope by means of a plurality of hanging structures;

the foldable windproof unit further comprises a traction rope, the traction rope is arranged on the horizontal pulley assembly in a sleeving manner, and the two free ends of the traction rope extend to respectively bypass the two vertical pulleys and are connected to a winding mechanism;

the hanging structure close to the tower on one side is fixedly connected to the traction rope, and the flexible windproof net is driven to be unfolded or folded through the forward and reverse rotation of the winding mechanism.

2. The foldable windproof unit according to claim 1, wherein the hanging structure employs a suspension pulley.

3. The foldable windproof unit according to claim 1, wherein the horizontal pulley assembly comprises a single horizontal pulley, a spacing distance between the two vertical pulleys is equal to the diameter of the horizontal pulley, the height of the horizontal pulley is identical to that of the vertical pulley; or the horizontally pulley assembly comprises two horizontal pulleys, the spacing distance between the two vertical pulleys is equal to a spacing distance between the two horizontal pulleys, and the height of the horizontal pulley is identical to that of the vertical pulley.

4. The foldable windproof unit according to claim 1, wherein the cross section of the tower is of a U-shaped structure, the tower of the U-shaped structure forms an accommodating cavity for accommodating the folded flexible windproof net.

5. The foldable windproof unit according to claim 1, wherein two side edges of the flexible windproof net are connected to the corresponding towers by vertical edge connectors, respectively, and the bottom edge of the flexible windproof net is connected to ground anchors by bottom edge connectors.

6. The foldable windproof unit according to claim 5, wherein the vertical edge connectors and the bottom edge connector each comprises a safety hook.

7. The foldable windproof unit according to claim 1, comprising a plurality of limiting ropes, wherein the two ends of each of the limiting ropes are connected to the two towers, respectively; and the plurality of limiting ropes are distributed on the two surfaces of the flexible windproof net.

8. The foldable windproof unit according to claim 1, wherein the winding mechanism employs a double-drum winch mechanism; and the double-drum winch mechanism is arranged at the bottom of the tower.

9. A large-span windproof net structure, comprising a plurality of foldable windproof units according to claim 1, wherein the adjacent foldable windproof units share one tower, one side of the tower is provided with the vertical pulley, and the other side of the tower is provided with the horizontal pulley assembly.

10. The large-span windproof net structure according to claim 9, wherein the hanging structure employs a suspension pulley.

11. The large-span windproof net structure according to claim 9, wherein the horizontal pulley assembly comprises a single horizontal pulley, a spacing distance between the two vertical pulleys is equal to the diameter of the horizontal pulley, the height of the horizontal pulley is identical to that of the vertical pulley; or the horizontally pulley assembly comprises two horizontal pulleys, the spacing distance between the two vertical pulleys is equal to a spacing distance between the two horizontal pulleys, and the height of the horizontal pulley is identical to that of the vertical pulley.

12. The large-span windproof net structure according to claim 9, wherein the cross section of the tower is of a U-shaped structure, the tower of the U-shaped structure forms an accommodating cavity for accommodating the folded flexible windproof net.

13. The large-span windproof net structure according to claim 9, wherein two side edges of the flexible windproof net are connected to the corresponding towers by vertical edge connectors, respectively, and the bottom edge of the flexible windproof net is connected to ground anchors by bottom edge connectors.

14. The large-span windproof net structure according to claim 13, wherein the vertical edge connectors and the bottom edge connector each comprises a safety hook.

15. The large-span windproof net structure according to claim 9, comprising a plurality of limiting ropes, wherein the two ends of each of the limiting ropes are connected to the two towers, respectively; and the plurality of limiting ropes are distributed on the two surfaces of the flexible windproof net.

16. The large-span windproof net structure according to claim 9, wherein the winding mechanism employs a double-drum winch mechanism; and the double-drum winch mechanism is arranged at the bottom of the tower.

17. A windproof method, using a foldable windproof unit comprising:

a flexible windproof net, towers arranged at intervals, and a load-bearing rope erected on the two towers, wherein the tower on one side is provided with a horizontal pulley assembly, and the tower on the other side is provided with two vertical pulleys;

the top edge of the flexible windproof net is slidably connected to the load-bearing rope by means of a plurality of hanging structures;

the foldable windproof unit further comprises a traction rope, the traction rope is arranged on the horizontal pulley assembly in a sleeving manner, and the two free ends of the traction rope extend to respectively bypass the two vertical pulleys and are connected to a winding mechanism;

the hanging structure close to the tower on one side is fixedly connected to the traction rope, and the flexible windproof net is driven to be unfolded or folded through the forward and reverse rotation of the winding mechanism, the method comprising the following:

during wind prevention, the winding mechanism rotating forwards to drive hanging structures, by a traction rope, to move in a direction from a tower on the other side to a tower on one side along a load-bearing rope, the flexible windproof net is driven by the hanging structures to be gradually unfolded, and the unfolded flexible windproof net plays a role of wind prevention; and after the wind prevention is finished, the winding mechanism rotating reversely to drive the hanging structures, by the traction rope, to move in a direction from the tower on one side to the tower on the other side along the load-bearing rope, and the flexible windproof net is driven by the hanging structures to be gradually folded.

18. The windproof method according to claim 17, wherein the hanging structure employs a suspension pulley.

19. The windproof method according to claim 17, wherein the horizontal pulley assembly comprises a single horizontal pulley, a spacing distance between the two vertical pulleys is equal to the diameter of the horizontal pulley, the height of the horizontal pulley is identical to that of the vertical pulley; or the horizontally pulley assembly comprises two horizontal pulleys, the spacing distance between the two vertical pulleys is equal to a spacing distance between the two horizontal pulleys, and the height of the horizontal pulley is identical to that of the vertical pulley.

20. The windproof method according to claim 17, wherein the cross section of the tower is of a U-shaped structure, the tower of the U-shaped structure forms an accommodating cavity for accommodating the folded flexible windproof net.

* * * * *